US006698233B2

(12) United States Patent
Pfister et al.

(10) Patent No.: US 6,698,233 B2
(45) Date of Patent: Mar. 2, 2004

(54) ACTIVE SORPTION THERMAL STORAGE CONTAINER

(75) Inventors: Dennis M. Pfister, San Luis Obispo, CA (US); Kristoffer H. Pfister, San Luis Obispo, CA (US)

(73) Assignee: Sun Microsystems, Inc., Santa Clara, CA (US)

( * ) Notice: Subject to any disclaimer, the term of this patent is extended or adjusted under 35 U.S.C. 154(b) by 0 days.

(21) Appl. No.: 10/170,139

(22) Filed: Jun. 11, 2002

(65) Prior Publication Data

US 2002/0189279 A1 Dec. 19, 2002

Related U.S. Application Data

(63) Continuation-in-part of application No. 09/834,080, filed on Apr. 12, 2001, now Pat. No. 6,502,419.

(51) Int. Cl.[7] ..... F25B 17/08; F25B 33/00

(52) U.S. Cl. ..... 62/497; 62/480; 62/457.9

(58) Field of Search ..... 62/371, 457.9, 62/457.7, 238.1, 238.3, 494, 476, 480, 101, 109

(56) References Cited

U.S. PATENT DOCUMENTS 2,088,276 A * 7/1937 Nesselmann et al. ..... 62/335
5,186,020 A * 2/1993 Rockenfeller et al. ..... 62/457.9
5,628,205 A * 5/1997 Rockenfeller et al. ..... 62/480
5,802,870 A * 9/1998 Arnold et al. ..... 62/480
5,855,119 A * 1/1999 Pfister et al. ..... 62/259.2
5,855,121 A * 1/1999 Byrd et al. ..... 62/497
5,881,573 A * 3/1999 Ebbeson ..... 62/480
5,941,093 A * 8/1999 Bengt ..... 62/478

* cited by examiner

*Primary Examiner*—Chen Wen Jiang
(74) *Attorney, Agent, or Firm*—Gunnison, McKay & Hodgson, L.L.P.; Philip J. McKay

(57) ABSTRACT

A thermal storage device for maintaining the temperature of an article at a desired temperature for a length of time comprises a compartment within which the article may be positioned, an evaporator which is disposed in heat exchange relation with respect to the compartment, a receiver which is fluidly connected to the evaporator, a sorber which is fluidly connected between the evaporator and the receiver and which includes a sorbent that is capable of adsorbing a refrigerant, a desorbing device for desorbing the refrigerant from the sorbent, and a power connection device for releasably connecting an external power supply to the desorbing device. When the desorbing device is connected to the external power supply, the refrigerant is desorbed from the sorbent and communicated to the receiver. In addition, after the desorbing device is disconnected from the external power supply, the refrigerant within the receiver is evaporated in the evaporator and adsorbed onto the sorbent to thereby produce a cooling effect in the compartment.

15 Claims, 7 Drawing Sheets

ACTIVE SORPTION THERMAL STORAGE CONTAINER

This application is a continuation-in-part of U.S. patent application Ser. No. 09/834,080, which was filed on Apr. 12, 2001, now U.S. Pat. No. 6,502,419, and which is hereby incorporated herein by reference.

BACKGROUND OF THE INVENTION

The present invention relates to a thermal storage device for maintaining the temperature of an article at a desired temperature for a period of time. More particularly, the invention relates to such a device which comprises a sorption compression refrigeration system that, when activated by an external power supply, generates a quantity of pressurized refrigerant that may later be controllably evaporated to produce a cooling effect and thereby maintain the temperature of the article at the desired temperature for a period of time.

The present invention is particularly useful as a shipping container for refrigerated articles, such as frozen foods. Frozen foods must usually be shipped in refrigerated trucks or individual shipping containers which are packed with ice. However, refrigerated trucks are generally not well insulated and therefore require one or more relatively large vapor compression refrigeration units to maintain the temperature of the cargo at a desired temperature. These refrigeration units are typically powered by the electrical system of the truck; consequently, they can significantly reduce the fuel efficiency of the truck. In addition, the use of a refrigerated truck is not economical when less than an entire truckload of articles is to be shipped. On the other hand, ice-packed shipping containers do not allow for precise temperature control, require a fresh source of ice each time they are used, and must be packed and shipped before the ice melts. Consequently, these types of shipping containers are usually only practical when shipping certain types of articles relatively short distances.

SUMMARY OF THE INVENTION

In accordance with the present invention, these and other limitations in the prior art are overcome by providing a thermal storage device for maintaining the temperature of an article at a desired temperature for a length of time. The thermal storage device comprises a compartment within which the article may be positioned, an evaporator which is disposed in heat exchange relation with respect to the compartment, a receiver which is fluidly connected to the evaporator, a sorber which is fluidly connected between the evaporator and the receiver and which includes a sorbent that is capable of adsorbing a refrigerant, means for desorbing the refrigerant from the sorbent, and means for releasably connecting an external power supply to the desorbing means. When the desorbing means is connected to the external power supply, the refrigerant is desorbed from the sorbent and communicated to the receiver. Furthermore, after the desorbing means is disconnected from the external power supply, the refrigerant within the receiver may be evaporated in the evaporator and adsorbed onto the sorbent to thereby produce a cooling effect in the compartment. Thus, the thermal storage device is capable of cooling the compartment after it has been disconnected from the external power supply.

In a preferred embodiment of the invention, the desorbing means comprises first and second electrical conductors between which the sorbent is positioned, and the connecting means includes a pair of electrical leads which are electrically connected to the first and second conductors. In addition, the sorbent and the refrigerant are selected such that, when an electrical current is conducted through the sorbent, the current will desorb the refrigerant from the sorbent. In this manner, the refrigerant may be desorbed from the sorbent by connecting the leads to the external power supply, which can be a conventional source of line voltage. This provides a convenient means for "charging" the thermal storage device prior to use.

In one embodiment of the invention, the thermal storage device includes means for controlling the flow of refrigerant into the evaporator. Such means could be, for example, an orifice valve, a capillary tube, or a manual, electrical or pressure actuated valve. Thus, when the temperature of the article rises above the desired temperature, the flow control means is operable to allow the refrigerant to evaporate and thereby cool the article.

In another embodiment of the invention, the thermal storage device comprises a valve which is fluidly connected between the receiver and the evaporator, a temperature sensor which is thermally connected to the compartment, and means for indicating whether the temperature of the compartment is above the desired temperature. Thus, when the temperature of the compartment rises above the desired temperature, the valve may be opened to allow the refrigerant to evaporate and thereby cool the compartment.

In yet another embodiment of the invention, the thermal storage device includes a controllable valve which is fluidly connected between the receiver and the evaporator, a temperature sensor which is thermally connected to the compartment, and a controller which is connected to both the temperature sensor and the valve. Thus, when the temperature of the compartment rises above the desired temperature, the controller will open the valve to allow the refrigerant to evaporate and thereby cool the compartment. More preferably, the controller also operates to close the valve when the temperature of the compartment drops below the desired temperature. In this manner, the thermal storage device can automatically maintain the temperature of the compartment, and thus the article, at the desired temperature for a length of time.

These and other objects and advantages of the present invention will be made apparent from the following detailed description, with reference to the accompanying drawings. In the drawings, the same reference numbers are used to denote similar elements in the various embodiments.

DETAILED DESCRIPTION OF THE PREFERRED EMBODIMENTS

Figure 1:
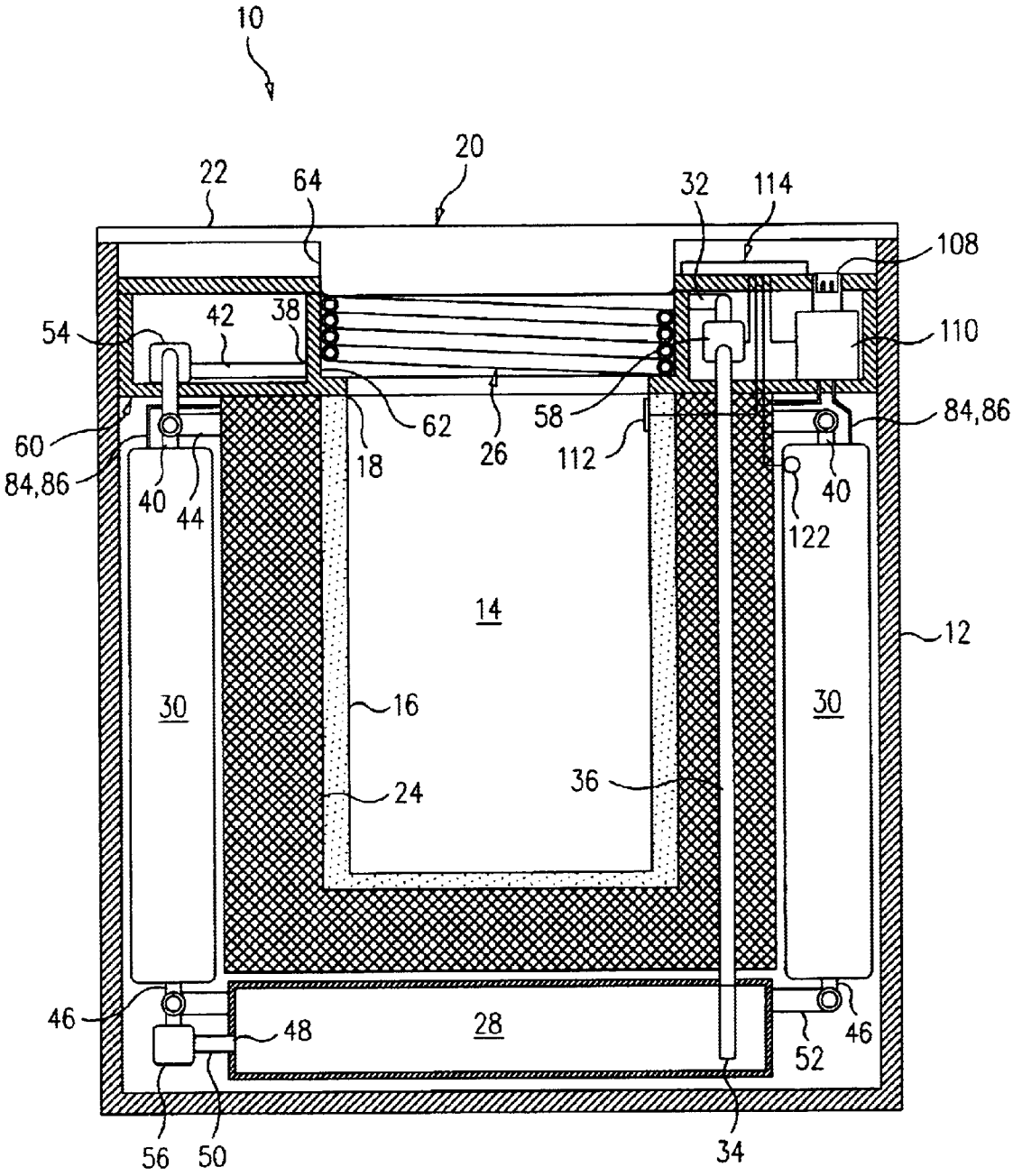
FIG. 1 is a cross sectional view of an embodiment of a thermal storage device of the present invention.

The present invention employs a sorption compression system to first generate a quantity of pressurized refrigerant and then evaporate the refrigerant at a later time to produce a cooling effect. In existing adsorption and absorption compression systems, which will be referred to herein simply as sorption compression systems, a first, typically gaseous substance called a sorbate is alternately adsorbed (or absorbed) onto and desorbed from a second, typically solid substance called a sorbent. Particular sorption compression systems utilize specific sorbates and sorbents to produce a desired effect which is dependent upon the affinity between the two substances. During the adsorption reaction, the sorbate is drawn onto and combines with the sorbent to produce a sorbate/sorbent compound. During the desorption reaction, energy is supplied to the sorbate/sorbent compound to break the bonds between the sorbate and sorbent molecules and thereby desorb the sorbate from the sorbent. In this reaction, the sorbate molecules are driven off of the sorbent molecules and into a relatively high pressure, high energy gaseous state. Substantial energy is imparted to the sorbate during the desorption reaction, and this energy can be harnessed for various uses.

For example, in a sorption compression refrigeration system the sorbate is typically a refrigerant. During the desorption reaction, which occurs in an enclosure that is sometimes called a sorber, the refrigerant is driven off of the sorbent and into a relatively high pressure gaseous state. The refrigerant gas is subsequently condensed and then, during the adsorption reaction, evaporated to produce a cooling effect. The refrigerant is specifically selected in conjunction with the sorbent to evaporate at a desired temperature when exposed to the sorbent. Therefore, as soon as the refrigerant is evaporated it is once again adsorbed onto the sorbent. The desorption and adsorption reactions may be repeated numerous times depending on the cooling requirements of the refrigeration system.

The thermal storage device of the present invention takes advantage of the fact that, in a sorption compression refrigeration system, the pressurized refrigerant is produced during the desorption reaction but the cooling effect is produced during the adsorption reaction. Therefore, energy from an external power supply need only be applied to the system during the desorption reaction. Moreover, the pressurized refrigerant does not have to be evaporated and re-adsorbed onto the sorbent immediately after the desorption reaction. Therefore, the thermal storage device can be temporarily connected to an external power supply to desorb the refrigerant from the sorbent, and then disconnected from the power supply and transported as desired. Furthermore, the sorbent can be evaporated to produce a cooling effect after the thermal storage device is disconnected from the power supply, for example while the device is in transit. Thus, the thermal storage device of the present invention is in effect a "thermal battery" which is capable of storing a "cooling potential" and then releasing this cooling potential at a later time.

Referring to FIG. 1, an embodiment of the present invention is shown which is particularly useful as a shipping container. The thermal storage device of this embodiment, which is indicated generally by reference number 10, is shown to comprise an outer housing 12 that encloses a compartment 14 into which one or more articles to be refrigerated may be placed. The compartment 14 is surrounded by a container 16 which includes an upper opening 18 that is sealed by a removable lid 20. The container 16 may comprise any suitable, preferably insulating device, such as a vacuum vessel. The lid 20 optimally includes an outwardly extending flange 22 which may be secured to the housing 12 to maintain the lid in position over the opening 18. The insulating characteristics of the container 16 may be improved by surrounding the container with a layer of, for example, foam insulation 24.

The thermal storage device 10 also comprises a sorption compression refrigeration system that includes an evaporator 26, a receiver 28 and a number of sorbers 30 which are connected together in a closed refrigeration loop. Thus, an inlet 32 of the evaporator 26 is fluidly connected to an outlet 34 of the receiver 28 by a conduit 36. Also, an outlet 38 of the evaporator 26 is in communication with an inlet 40 of each sorber 30 via a conduit 42, which may be connected to each sorber either directly or via a first manifold 44, as shown in FIG. 1. Furthermore, an outlet 46 of each sorber 30 is in communication with an inlet 48 of the receiver 28 via a conduit 50, which may be connected to the receiver either directly or, as shown in FIG. 1, through a second manifold 52.

The thermal storage device ideally also comprises suitable means for controlling the flow of the refrigerant through the refrigeration loop. For example, a first check valve 54 may be positioned in the conduit 42 to ensure that the refrigerant flows from the evaporator 26 only to the sorbers 30. Similarly, a second check valve 56 may be positioned in the conduit 50 to ensure that the refrigerant flows from the sorbers 30 only to the receiver 28. Also, a flow control device 58 may be positioned in the conduit 36 to control the release of the refrigerant into the evaporator 26 for the cooling of the compartment 14. The operation of the device 58, which could be, for example, an orifice valve, a capillary tube, or a manual, electrical or pressure actuated valve, will be described more fully below.

The evaporator 26 can be any conventional heat exchange device which is capable of absorbing heat from the compartment 14. The evaporator should therefore be disposed in heat exchange relation with respect to the compartment 14. Accordingly, the evaporator 26 may be positioned in the compartment 14, attached to the lid 20 or incorporated into the container 16. However, in the embodiment of the invention shown in FIG. 1 the evaporator 26 is positioned above the opening 18 in a support ring 60 that is secured to the housing 12. The support ring 60 includes a through hole 62 which is aligned with the opening 18. In addition, the lid 20 ideally comprises a central plug portion 64 which engages the through hole 62 to thereby seal the opening 18 from the outside environment.

The purpose of the receiver 28 is to contain the refrigerant after it has been desorbed from the sorbers 30 and before it is evaporated in the evaporator 26. Therefore, it should be understood that, depending on the volume of refrigerant which is desorbed from the sorbers 30, the receiver 28 need not necessarily comprise a separate container. Rather, the conduit 36 and/or the second manifold 46, if present, may have a sufficient volume to function as a suitable receiver.

Although the present invention preferably does not include a separate condenser, in the event thermal energy is used to desorb the refrigerant from the sorbent, suitable means should be provided to allow the refrigerant to condense and the heat of condensation to be removed from the refrigerant. In many instances, the receiver 28 may be sufficient for this purpose. Otherwise, a suitable condenser could be inserted in the refrigeration loop between the sorbers 30 and the receiver 28 or the evaporator 26.

As mentioned above, each sorber 30 is the enclosure within which the desorption and adsorption reactions take place. Therefore, the sorber 30 must function to contain the sorbent and provide for the communication of the refrigerant to and from the sorbent. In addition, depending on the particular mechanism which is employed to desorb the refrigerant from the sorbent, the sorber 30 must at least accommodate and in some cases even facilitate the desorption reaction. In one embodiment of the invention, the sorption compression system utilizes an electrical current as the desorption mechanism. Therefore, the sorber 30 is optimally designed to conduct the electrical current to the sorbent in order to effect the desorption of the refrigerant from the sorbent.

Figure 2:
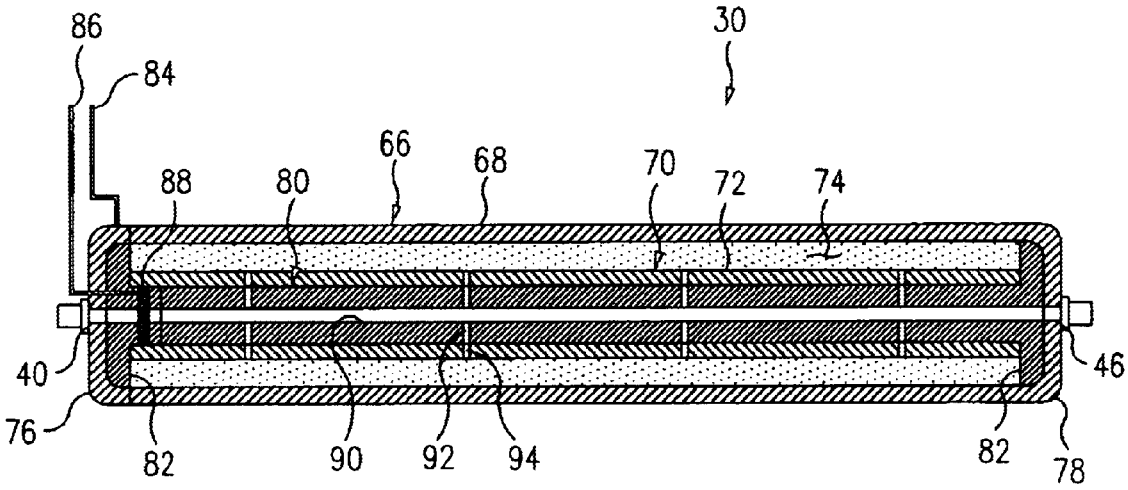
FIG. 2 is a longitudinal cross sectional view of the sorber component of the thermal storage device depicted in FIG. 1.

Referring to FIG. 2, the sorber 30 is thus shown to include a tubular, preferably cylindrical housing 66 which comprises a first electrical conductor 68, a cylindrical sleeve 70 which comprises a second electrical conductor 72, and a sorbent 74 which is positioned between the first and second conductors. The housing 66 comprises a first end 76 through which the sorber inlet 40 extends and a second end 78 through which the sorber outlet 46 extends. The sleeve 70 is supported on a shaft 80 which includes two enlarged diameter end portions 82 that engage the inner diameter of the housing 66 to maintain the second conductor 72 properly positioned relative to the first conductor 68. One of the end portions 82 may be detachable from the shaft 80 to allow the sleeve 70 to be assembled onto the shaft. In addition, one of the ends 76, 78 of the housing 68 may be a separate piece which is attached to the housing by suitable means, such as welding, after the sorbent 74, the sleeve 70 and the shaft 80 have been inserted into the housing.

As will be discussed more fully below, during each desorption reaction the first and second conductors 68, 72 conduct a current through the sorbent 74 to desorb the refrigerant from the sorbent. Accordingly, the first and second conductors are made from a suitable electrically conducting material, such as an aluminum alloy, and are each connected to corresponding leads 84, 86 by suitable means. For example, the lead 84 may be soldered to the first conductor 68, and the lead 86 may be connected to a slip ring 88 which is mounted on the shaft 80 and engages the inner diameter of the second conductor 72 when the sorber 30 is assembled. The shaft 80 is optimally made of a lightweight, non-conducting material, such as polyethylene. Consequently, the shaft 80 will serve to insulate the first conductor 68 from the second conductor 72.

In order to provide for the communication of the refrigerant to and from the sorbent 74, the shaft 80 is provided with a longitudinal bore 90 which extends between the inlet 40 and the outlet 46, and a number of radial holes 92 which pass through the shaft and intersect the longitudinal bore. The radial holes 92 in turn communicate with a corresponding number of apertures 94 in the sleeve 70. Thus, during each adsorption reaction the refrigerant will enter the sorber 30 through the inlet 40 and be communicated to the sorbent 74 through the longitudinal bore 90, the radial holes 92 and the apertures 94. Similarly, during each desorption reaction the refrigerant will pass through the apertures 94, the radial holes 92 and the longitudinal bore 90 and exit the sorber 30 through the outlet 46.

Figure 3:
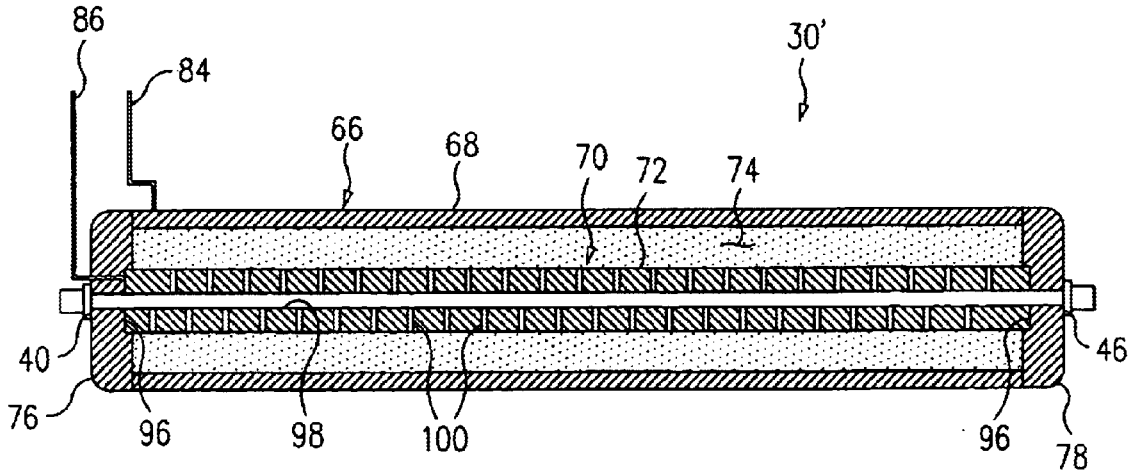
FIG. 3 is a longitudinal cross sectional view of an alternative sorber for the thermal storage device depicted in FIG. 1.

FIG. 3 illustrates an alternative sorber which may be used to facilitate the desorption of the refrigerant from the sorbent using an electrical current. The sorber of this embodiment, which is indicated generally by reference number 30', is similar to the sorber 30 in that it includes a housing 66 which comprises a first electrical conductor 68, a sleeve 70 which comprises a second electrical conductor 72 and a sorbent 74 which is disposed between the first and second conductors. However, in this embodiment each end of the sleeve 70 is supported in a corresponding receptacle 96 which is formed in each of the first and second ends 76, 78 of the housing 66. Thus, a shaft such as 80 is not required to support the sleeve 70 in the housing 66. In order to provide for the communication of the refrigerant between the refrigeration loop and the sorbent 74, the sleeve 70 includes a longitudinal bore 98 which extends between the inlet 40 and the outlet 46, and a number of radial bores 100 which extend between the longitudinal bore and the outer diameter of the sleeve.

As in the sorber 30, the housing 66 and the sleeve 70 are preferably made of a suitable electrically conducting material. Thus, the housing 66 must be electrically insulated from the sleeve 70. This may be accomplished by positioning an insulating gasket (not shown) between the ends of the sleeve 70 and the receptacles 96. Alternatively, either the ends of the sleeve 70 or the receptacles 96, or both, may be treated, such as by anodizing, to create an electrically insulating coating between theses components. In one embodiment of the invention, the entire ends 76, 78 of the housing 66 are so treated to limit the flow of current to the cylindrical portion of the housing which is located between the ends.

Figure 4:
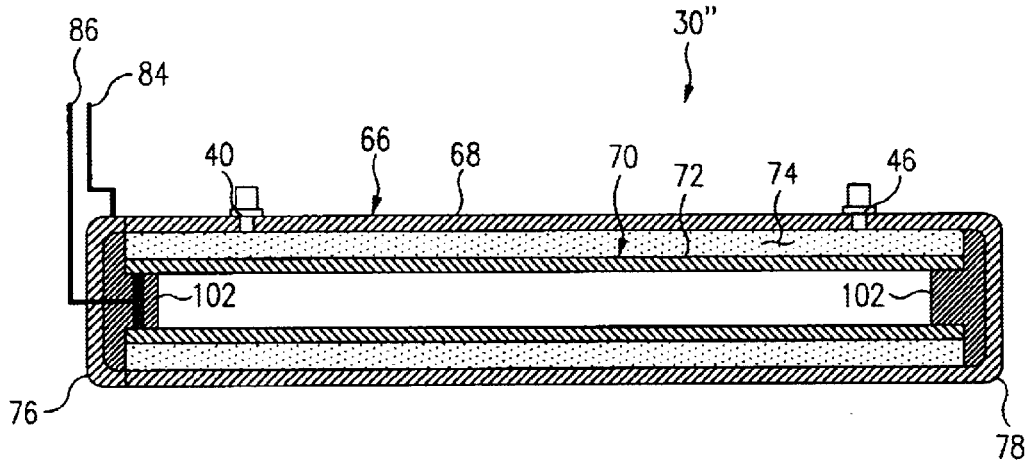
FIG. 4 is a longitudinal cross sectional view of another alternative sorber for the thermal storage device depicted in FIG. 1.

Another embodiment of a sorber which can be used to facilitate the desorption of the refrigerant from the sorbent using an electrical current is shown in FIG. 4. The sorber of this embodiment, which is indicated generally by reference number 30", is shown to include a housing 66 which comprises a first electrical conductor 68, a sleeve 70 which comprises a second electrical conductor 72, and a sorbent 74 which is disposed between the first and second conductors. In this embodiment the sleeve 70 is supported between a pair of plug members 102. In addition, the inlet 40 and the outlet 46 both extend through the portion of the housing 66 which is located between the ends 76, 78. Therefore, the refrigerant may be communicated between the sorbent 74 and the refrigeration loop directly through the inlet 40 and the outlet 46.

The operation of the sorbers 30, 30' and 30" will now be described. During the adsorption reaction, refrigerant from the evaporator 26 is communicated to the sorbent through the inlet 40. The refrigerant combines with the sorbent in this reaction to form a refrigerant/sorbent compound. The refrigerant thus remains trapped within the sorber until a desorption reaction is initiated. During the desorption reaction, an electrical current from an external power supply, which will be discussed below, is conducted by the first and second conductors 68, 72 across the refrigerant/sorbent compound to desorb the refrigerant from the sorbent. The electrical current liberates the refrigerant molecules from the sorbent molecules, and the resulting high pressure, high energy refrigerant expands through the outlet 46 and into the receiver 28. During this reaction, the check valve 54 prevents the refrigerant from expanding back into the evaporator 26.

The exact mechanism by which the electrical current effects the desorption of the refrigerant molecules from the sorbent molecules varies depending on the type of sorbent employed. Moreover, while the exact mechanism is not known, the inventors believe that, when the current is conducted through the refrigerant/sorbent compound, electrons are channeled into each refrigerant—sorbent bond until the bond is broken and the refrigerant molecule is liberated from the sorbent molecule. With respect to the carbon based sorbents which will be discussed below, one theory is that the electrons from the power supply displace the electrons of the refrigerant molecule in the conduction band of the sorbent molecule, thereby freeing the refrigerant molecule from the sorbent molecule. Another theory is that the electrons impart sufficient energy to the refrigerant molecule to allow it to escape the electrical potential binding it to its associated sorbent molecule.

The selection of the particular refrigerant and sorbent materials for the thermal storage device 10 depends in part on the desired electrical and thermal conductivities of these materials. Since in one embodiment of the invention the desorption reaction is driven by an electric current, the refrigerant/sorbent compound should be a good electrical conductor. In addition, in the event that the refrigerant molecules bind only to the surface of the sorbent during the adsorption reaction, the sorbent should also be a good electrical conductor. Moreover, if the external power supply is an AC power supply, the refrigerant and sorbent materials should ideally be selected so that the combined impedance of the sorber and the refrigerant/sorbent compound matches that of the power supply to ensure that the maximum amount of power is transferred from the power supply to the refrigerant/sorbent compound. If on the other hand the external power supply is a DC power supply, the refrigerant and sorbent materials should optimally be selected so that the combined resistance of the sorber and the refrigerant/sorbent compound, or the combined resistance of the sorber and the sorbent alone, is sufficient to avoid overloading the power supply.

Furthermore, during each adsorption reaction the kinetic energy of the refrigerant molecules is converted to heat as the refrigerant molecules combine with the sorbent molecules. This heat, which is often referred to as the heat of adsorption, inhibits the further adsorption of the refrigerant onto the sorbent and should therefore be dissipated from the sorbent. Therefore, both the refrigerant/sorbent compound and the sorbent are ideally good thermal conductors. In a preferred embodiment of the invention, the sorbent comprises a thermal conductivity at least as great as that of aluminum or copper. It has been found that using a sorbent with such a thermal conductivity and a refrigerant that meets the other requirements of the sorption compression system will result in a refrigerant/sorbent compound that has a sufficient thermal conductivity for purposes of the present invention.

The selection of the refrigerant and sorbent materials also depends on the desired nature of the desorption reaction. In accordance with one embodiment of the invention, the refrigerant and sorbent materials are selected such that, when the electrical current is conducted through the refrigerant/sorbent compound to effect the desorption reaction, the refrigerant/sorbent compound is not heated appreciably. Thus, the desorption reaction is substantially non-thermal. In the context of the present invention, "non-thermal desorption" refers to a mechanism of desorption that does not rely on thermal energy to stochastically heat the refrigerant/sorbent compound to the degree sufficient to break the bonds between the refrigerant and sorbent molecules. Thus, while some isolated, localized heating of the refrigerant/sorbent compound may occur during the desorption reaction, the temperature of the refrigerant/sorbent compound should remain statistically below the threshold temperature for thermal desorption to take place.

One method for determining whether a particular desorption reaction is either thermal or substantially non-thermal is to measure the bulk temperature of the refrigerant/sorbent compound during the desorption reaction. If the bulk temperature of the compound during the desorption reaction is greater than the known temperature which is required to effect a thermal or heat-activated desorption, then the reaction is thermal. However, if the bulk temperature of the refrigerant/sorbent compound during the desorption reaction is less than the temperature required to effect the thermal desorption, the reaction may or may not be thermal.

In this event, the velocity distribution of the desorbed refrigerant molecules may be analyzed to determine whether the desorption reaction is substantially non-thermal. The molecular velocity distribution can be determined by, for example, using time-of-flight spectroscopy to produce a time-resolved distribution of the florescence intensities of a characteristic molecular beam. Then, using a Fourier transform, the molecular velocity distribution can be extracted from the florescence data. Since it is known that in a non-thermal process the velocity distribution of the desorbed refrigerant molecules should be primarily non-Maxwellian, by analyzing the time-of-flight spectroscopy data, the thermal/non-thermal nature of the desorption process can be determined.

The sorbent should also comprise certain physical properties to enable it to be effectively utilized in the thermal storage device 10. For example, the sorbent is preferably sufficiently strong to withstand repeated adsorption and desorption reactions without fracturing or decomposing. In addition, the sorbent is ideally comprised of a material that can be soldered, brazed or otherwise attached to the sorber to enhance the transfer of thermal and electrical energy through the junction between the sorbent and the sorber. Furthermore, the sorbent is optimally configured or constructed to comprise suitable mass transfer paths to facilitate the passage of a maximum amount of refrigerant through the sorbent in a minimum amount of time during the adsorption and desorption reactions. Also, since the total amount of refrigerant that can be adsorbed on a sorbent is proportional to the total surface area of the sorbent, the sorbent preferably comprises a relatively large surface area per unit volume of material.

Consistent with the above discussion, suitable sorbent materials for use in the present invention include pitch-based carbon and graphitic foams, examples of which are disclosed in U.S. Pat. Nos. 5,961,814 and 6,033,506, which are hereby incorporated herein by reference. Another suitable sorbent material is a graphitic foam product which is available from Poco Graphite, Inc. of Decatur, Tex. under the brand name PocoFoam™. In order to improve the adsorption capacity of these foams, they may be activated using any suitable activation technique. Alternatively, the sorbent could comprise a pre-activated graphitic foam product, such as is described in applicants' co-pending U.S. patent application Ser. No. [Docket No. SUNM-P006 US], which is hereby incorporated herein by reference.

Simple carbon and graphite pellets, granules, powders and fibers may also be used as the sorbent material. These materials are preferably activated using a suitable activation method in order to improve their adsorption capacity. Also, any of the sorbent materials disclosed in applicants' U.S. patent application Ser. No. 09/834,080 may be used in the present invention. It should be understood that this list of possible sorbent materials is not complete, and that other materials which meet some or all of the above-listed requirements, including liquid materials, may also make suitable sorbents. The present invention should therefore not be limited by the particular sorbent materials listed above.

The refrigerant which is employed in the thermal storage device 10 depends in large part on the sorbent selected and the temperature differential desired to be achieved between the compartment 14 and the ambient atmosphere. Generally, once a suitable sorbent is chosen an appropriate refrigerant may be selected by examining the vapor pressure curves for various refrigerant/sorbent compounds. The inventors have discovered that suitable refrigerants for use with the carbon and graphitic foam sorbents discussed above include R134, Ammonia, Carbon Dioxide, Nitrous Oxide, Nitrogen, Krypton, Hydrogen and Methane, among others.

Figure 5:
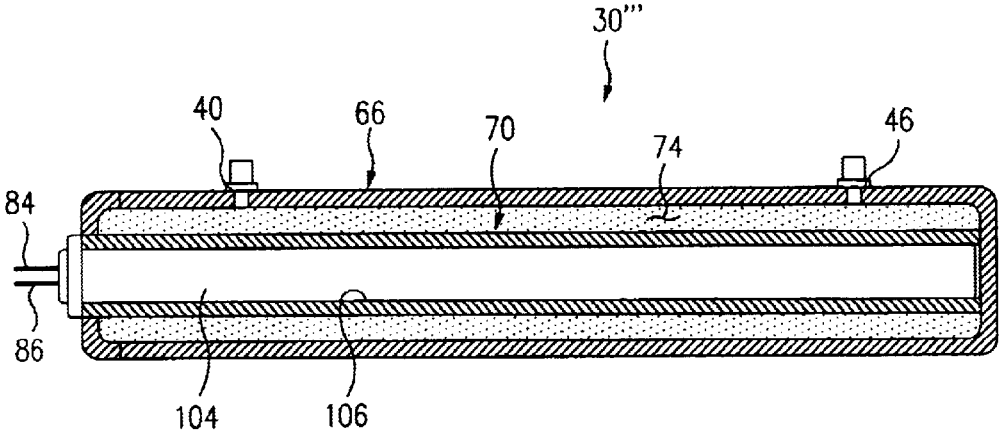
FIG. 5 is a longitudinal cross sectional view of yet another alternative sorber for the thermal storage device depicted in FIG. 1.

In accordance with another embodiment of the present invention, thermal energy may be used to effect the desorption of the refrigerant from the sorbent. Referring to FIG. 5, a sorber which may be used with such a desorption mechanism is indicated generally by reference number 30'''. Similar to the sorbers discussed above, the sorber 30''' comprises a tubular, preferably cylindrical housing 66, an optional heater mounting sleeve 70 which is secured with the housing such as by welding, and a sorbent 74 which is positioned between the housing and the sleeve. In this embodiment, thermal energy is provided by a suitable heater 104, such as an electrical resistance or gas combustion heater, which is supported in a longitudinal bore 106 in the mounting sleeve 70. In the event the heater 104 is an electrical resistance heater, it is ideally connected to an external power source via a pair of electrical leads 84, 86. The refrigerant is communicated between the sorbent 74 and the refrigeration loop through an inlet 40 and an outlet 46. Suitable refrigerant and sorbent materials for this embodiment include the refrigerant and sorbent materials discussed above.

In operation of the sorber 30''', the desorption reaction is initiated by activating the heater 104. When activated, the heater 104 will generate thermal energy in the form of heat, and this heat will be conducted through the sleeve 70 to the refrigerant/sorbent compound. Accordingly, the sleeve 70 is preferably made of a thermally conductive material, such as aluminum. When the refrigerant/sorbent compound is stochastically heated to a degree sufficient to break the bonds between the refrigerant and sorbent molecules, the refrigerant will begin to desorb from the sorbent. Continued heating of the refrigerant/sorbent compound will ensure that a desired amount of refrigerant is desorbed from the sorbent.

In accordance with the present invention, the power required to drive the desorption reactions in each of the sorber embodiments described above is supplied by an external power supply, such as a source of conventional line voltage. Referring again to FIG. 1, the thermal storage device 10 comprises a power jack 108 which is connected to the external power supply by a suitable cable (not shown). If the power from the external power supply is not in a form that is usable by the sorbers 30, the thermal storage device 10 may also comprise an internal power supply 110. The internal power supply 110 is connected to the jack 108 and may include, for example, conventional transformer, rectifier, filter and regulator devices for converting the voltage from the external power supply into a current which is required to power the sorbers 30. Each of the sorbers 30 is electrically connected to the internal power supply 110 by a pair of leads 84, 86.

During the assembly of the thermal storage device 10, the refrigeration loop is evacuated and the sorbers 30 are each charged with a predetermined amount of refrigerant by adsorbing the refrigerant onto the sorbent. In order to prepare the thermal storage device 10 for transport, the valve 58 is closed and the external power supply is connected to the jack 108. The power supply is then activated to desorb the refrigerant from the sorbent. As the refrigerant is desorbed from the sorbent, it will expand into the receiver 28 and the conduit 36, where it will condense and remain until the compartment 14 requires cooling.

The amount of power and the approximate length of time required to complete the desorption reaction are dependent on the amounts and types of refrigerant and sorbent materials used in the sorption compression refrigeration system. For example, if the system requires $X_{sorbate}$ grams of refrigerant and it is known that $E_{desorb}$ joules of energy are required to desorb one gram of refrigerant from the sorbent, then a total of $E_{desorb}$ joules/gram times $X_{sorbate}$ grams= $E_{total}$ joules of energy will be required to completely desorb the refrigerant from the sorbent. The total desorption time, $t_{desorb}$, is obtained by dividing $E_{total}$ by the applied power level, $P_{supply}$.

The compartment 14 may then be loaded with articles to be shipped or refrigerated. If the articles have been pre-refrigerated, the flow control device 58 will remain closed until the temperature of the articles rises above a predetermined desired temperature. In this event, the flow control device 58 will operate to allow some of the refrigerant to pass into the evaporator, where it will evaporate and thereby cool the articles to the desired temperature. If the articles have not been pre-refrigerated, the flow control device 58 will operate to allow the refrigerant to evaporate until the temperature of the articles drops to the desired temperature. The flow control device 58 will then operate to retain the remaining portion of the refrigerant within the receiver 28. If the temperature of the articles subsequently rises above the desired temperature, the flow control device 58 will again operate to allow more refrigerant to evaporate and further cool the articles.

A particularly advantageous feature of the present invention is the ability of the sorber to control the flow of the refrigerant into the evaporator 26 without a separate flow control device 58 positioned upstream of the evaporator. Therefore, the sorber itself may be used as the flow control device. As mentioned above, the heat of adsorption will inhibit the ability of the sorbent to adsorb additional refrigerant. Thus, once the heat of adsorption raises the temperature of the sorbent above a certain temperature, the sorbent will substantially stop adsorbing additional refrigerant. Moreover, the sorbent will not be able to absorb additional refrigerant until the sorbent is cooled by removing the heat of adsorption.

Therefore, for a given range of ambient conditions, the sorber can be designed so that the heat of adsorption will be dissipated from the sorbent at the same rate at which the ambient heat is transferred to the compartment 14. In this manner, as the ambient heat is transferred to the compartment 14, the heat of adsorption will be dissipated from the sorbent. Moreover, as the heat of adsorption is dissipated from the sorbent, the sorbent will be able to adsorb additional refrigerant. Consequently, the refrigerant will be drawn through the evaporator 26, where it will evaporate and thereby cool the compartment 14.

In another embodiment of the invention, the flow control device 58 comprises a capillary tube, an orifice valve, or a similar flow control device. Moreover, as is understood by those of skill in the art, the flow control device 58 is designed to maintain the desired temperature in the compartment 14. Thus, as the temperature in the compartment 14 rises above the desired temperature, the flow control device 58 will release the refrigerant into the evaporator, where it will evaporate and thereby cool the compartment 14. The evaporated refrigerant will then be re-adsorbed onto the sorbent.

In yet another embodiment of the invention, the flow control device 58 comprises a thermostatic expansion valve (TEV), a thermal expansion valve (TXV), or a similar flow control device. As is understood by those of skill in the art, such valves may be adjusted to maintain the desired temperature in the compartment 14. Thus, as the temperature in the compartment 14 rises above the desired temperature, the flow control device 58 will release the refrigerant into the evaporator, where it will evaporate and thereby cool the compartment 14. The evaporated refrigerant will then be re-adsorbed onto the sorbent.

Figure 6:
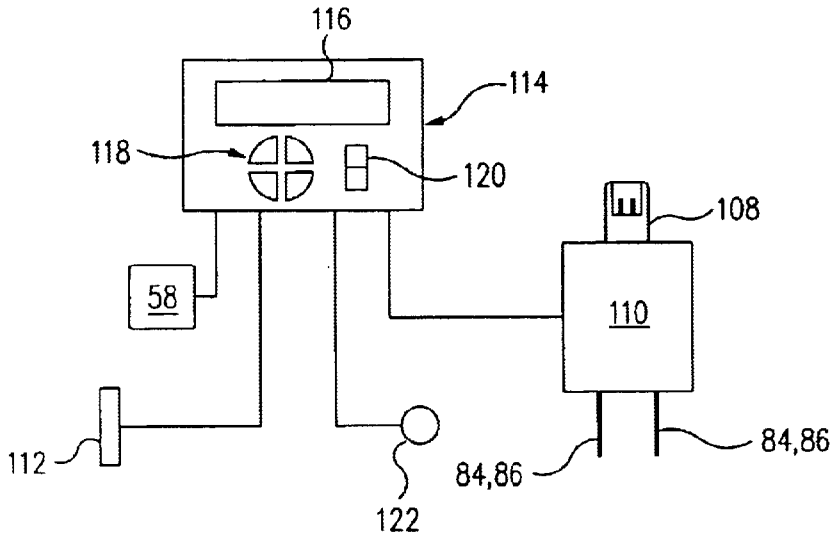
FIG. 6 is a diagrammatic representation of an exemplary control system for the thermal storage device depicted in FIG. 1.

Referring also to FIG. 6, in one embodiment of the invention the thermal storage device 10 comprises a temperature sensor 112 which is thermally coupled to the compartment 14, and a programmable controller 114 which is designed to manage certain operations of the thermal storage device in response to preprogrammed instructions that are stored in an associated memory device. The power required to operate the controller 114 and the devices which are attached to the controller is optimally provided by a portable power supply, such as a battery (not shown). The temperature sensor 112, which can be, for example, a conventional thermistor, generates a signal that is indicative of the temperature in the compartment 14 and sends this signal to the controller 114. The controller 114 then either displays this temperature on an associated display 116, or compares this temperature to a desired temperature for the compartment 14, which may be input into the controller using a simplified keypad 118. If the temperature in the compartment 14 rises above the desired temperature, the controller can provide a visual indication of such on the display 116 or an audible indication of such on a speaker (not shown). In the event the flow control device 58 is a manually operable valve, the operator of the thermal storage device can then open the valve to cool the compartment 14 as described above until the temperature of the compartment reaches the desired temperature.

In another embodiment of the invention, the flow control device 58 is a solenoid type valve which can be opened or closed with an appropriate electrical signal. In addition, the controller 114 includes a switch 120 which is connected to the valve 58. In this manner, the operator may open or close the valve 58 using the switch 120.

In yet another embodiment of the invention, the flow control device 58 is a solenoid type valve which can be opened or closed with an appropriate electrical signal, and the controller 60 actuates the valve to initiate and terminate each adsorption cycle. Thus, when the controller 114 determines that the temperature in the compartment 14 has risen above a desired temperature, it will generate an appropriate signal to open the valve 58. When the controller 114 then determines that the temperature of the compartment has dropped to a predetermined temperature below the desired temperature, it will generate an appropriate signal to close the valve 58. In this manner, the controller 114 can automatically maintain the temperature of the compartment 14, and thus the articles within the compartment, at the desired temperature.

The controller 114 may also be programmed to manage each desorption reaction. In this example, a switch similar to the switch 120 is connected to the internal power supply 110. In addition, the time required to complete the desorption reaction is determined, for example as described above, and input into the controller 114. The operator may initiate the desorption reaction by pressing the switch to activate the internal power supply 110. The controller will then provide a visual or audible indication when the time required to complete the desorption reaction has elapsed, whereupon the operator may terminate the desorption reaction by pressing the switch again to deactivate the internal power supply 110.

In another embodiment of the invention, the controller 114 can be programmed to automatically terminate the desorption reaction. For example, the controller can deactivate the internal power supply 110 when the time required to complete the desorption reaction has elapsed. Alternatively, the thermal storage device 10 may comprise a transducer 122 to measure a condition of the sorption compression refrigeration system which is indicative of the end of the desorption cycle, and the controller 114 can deactivate the internal power supply 110 once it receives the appropriate signal from the transducer. For example, when an electrical current is used to effect the desorption reaction and the sorbent comprises a carbon based material, the current will tend to resistively heat the sorbent after the refrigerant has been desorbed. Therefore, the transducer 122 could comprise a temperature sensor, which would enable the controller 114 to monitor the temperature of the sorber 30 and deactivate the internal power supply 110 when a predetermined increase in the temperature is detected. Also, as the refrigerant is desorbed from the refrigerant/sorbent compound, the impedance of the refrigerant/sorbent compound will decrease. Thus, the transducer 122 could comprise an impedance sensor, which would allow the controller 114 to sense a change in the impedance of the sorber 30 and deactivate the internal power supply 110 when the refrigerant has been desorbed. In addition, since the pressure within the receiver 28 will reach a maximum level once the entire amount of refrigerant is desorbed from the sorber 30, the transducer 122 could comprise a pressure sensor which is connected to the receiver. In this case, the controller 114 would sense the pressure in the receiver 28 and deactivate the internal power supply 110 once the maximum pressure is reached.

Figure 7:
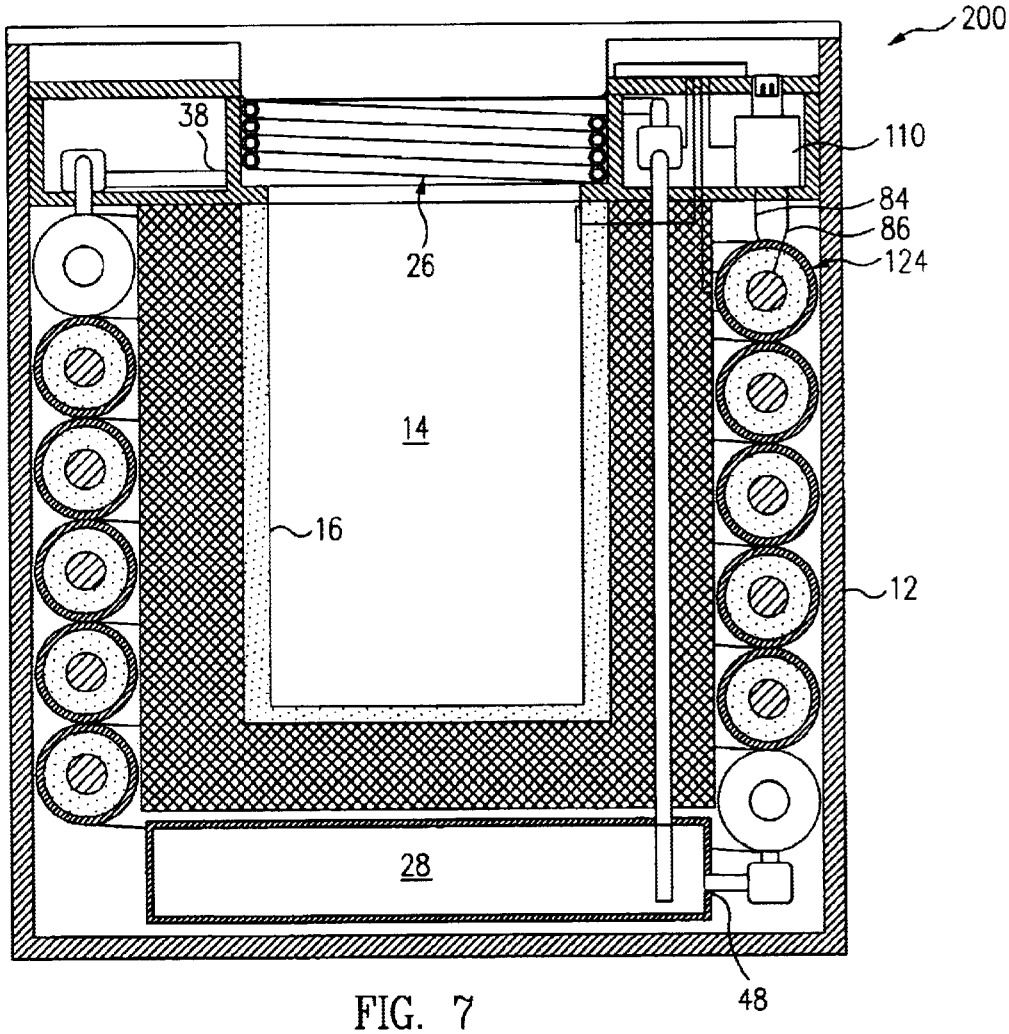
FIG. 7 is a cross sectional view of second embodiment of a thermal storage device of the present invention.

Referring now to FIG. 7, an embodiment of a thermal storage device is shown which is similar in many respects to the thermal storage device 10 just described. However, in this embodiment the thermal storage device, which is indicated generally by reference number 200, comprises a single sorber 124 which is helically wound around the container 16. The sorber 124 may be similar to any of the sorber embodiments described above, except that it is elongated to a degree sufficient to contain the entire amount of sorbent which may be required by the sorption compression refrigeration system. The advantage of this sorber design is that it may be connected directly between the outlet 38 of the evaporator 26 and the inlet 48 of the receiver 28. In addition, only a single pair of leads 84, 86 is required to connect the internal power supply 110 to the sorber 124. In all other respects, the construction and operation of the thermal storage device 200 is similar to those of the thermal storage device 10.

Figure 8:
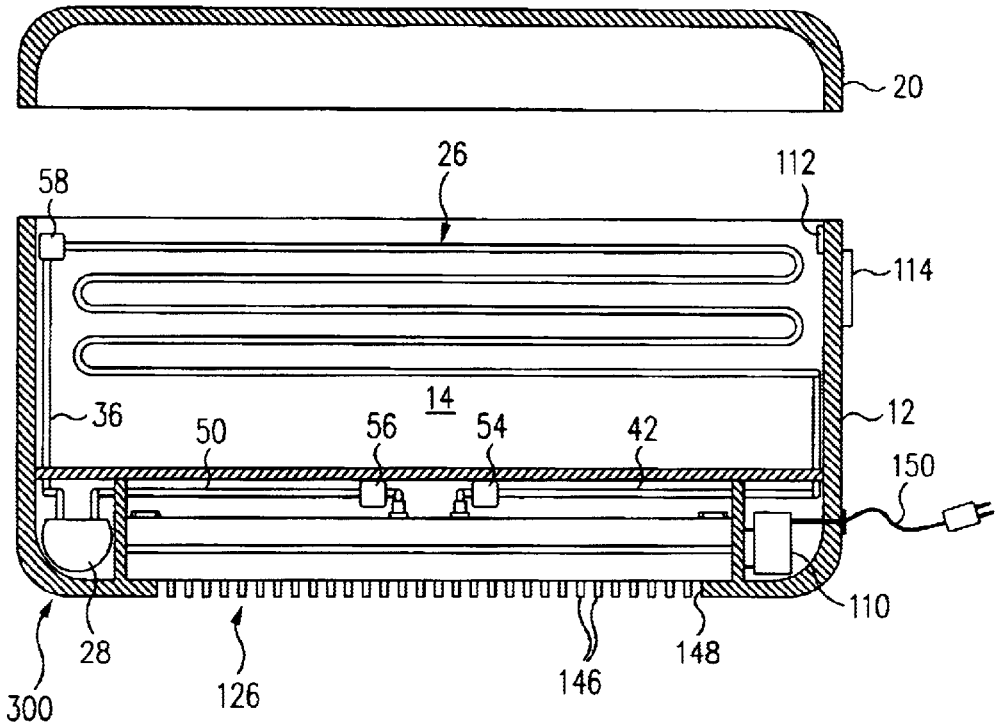
FIG. 8 is a cross sectional view of another embodiment of a thermal storage device of the present invention.

Yet another embodiment of a thermal storage device according to the present invention is shown in FIG. 8. The thermal storage device of this embodiment, which is indicated generally by reference number 300, is particularly suited for use as a cooler for transporting and storing refrigerated food items and the like. The thermal storage device 300 thus comprises a preferably insulated housing 12 which encloses a compartment 14, a lid 20 which is attachable to the housing to seal the compartment from the environment, and a sorption compression refrigeration system for maintaining the temperature in the compartment at a desired temperature. As in the previous embodiments, the sorption compression refrigeration system includes an evaporator 26 which is positioned in heat exchange relation with respect to the compartment 14, a receiver 28 which is fluidly connected to the evaporator, and a sorber 126 which is fluidly connected between the evaporator and the receiver.

Figure 9:
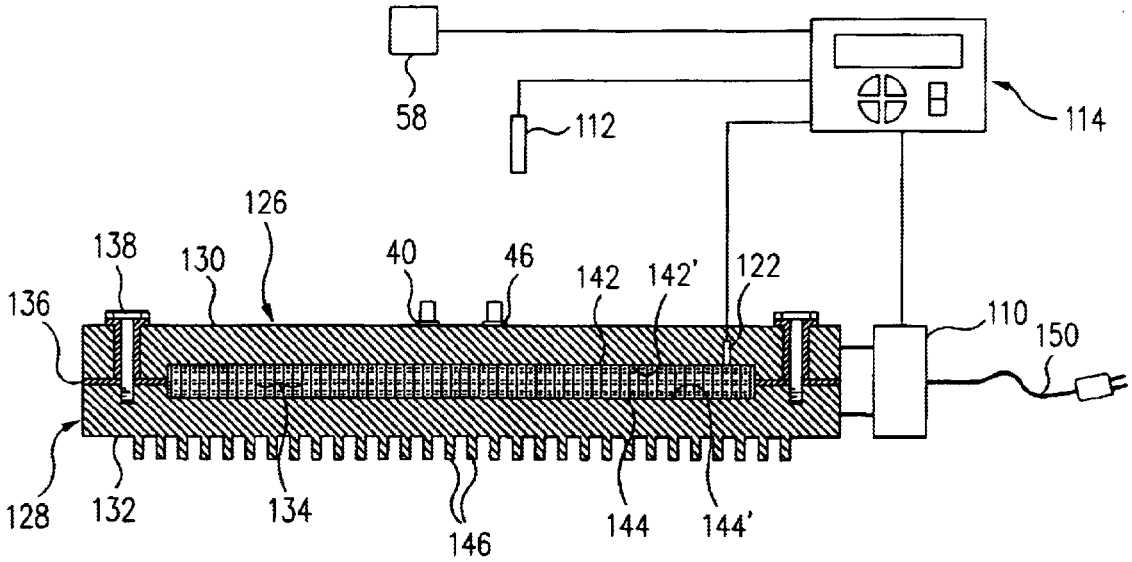
FIG. 9 is a partial cross sectional, partial schematic view of a portion of the thermal storage device depicted in FIG. 8.
Figure 10:
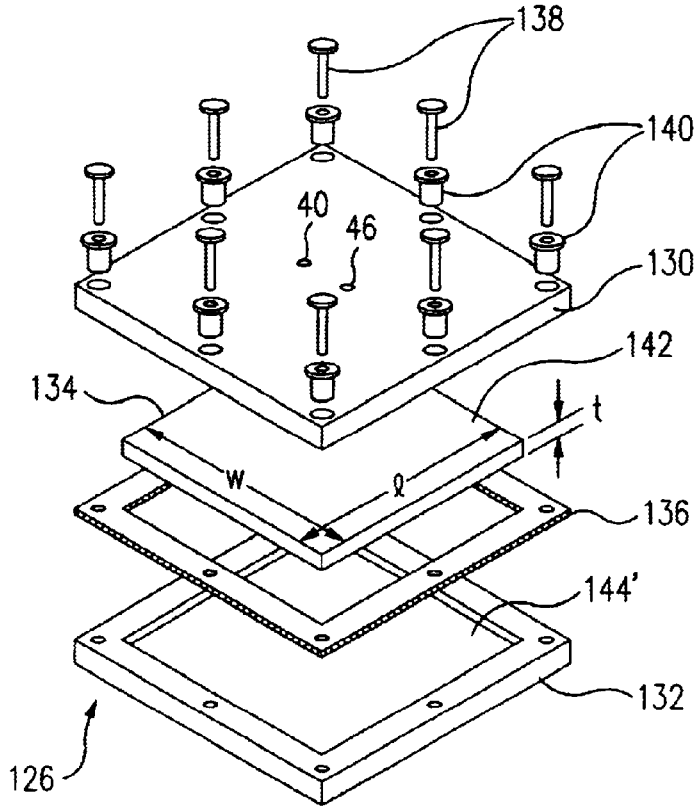
FIG. 10 is an exploded view of the sorber component of the thermal storage device depicted in FIG. 8.
Figure 11:
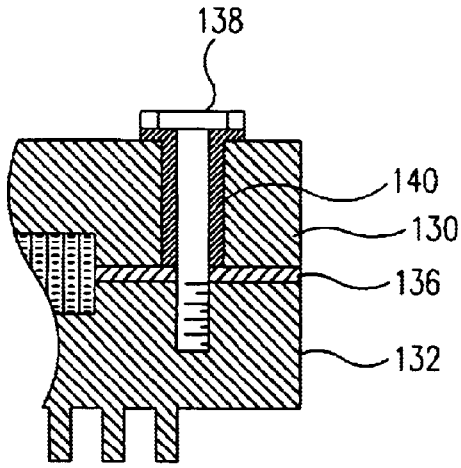
FIG. 11 is an enlarged cross sectional view of a portion of the sorber component of the thermal storage device depicted in FIG. 8.

The sorber 126 is especially useful in effecting the desorption of the refrigerant from the sorbent using an electrical current. Referring to FIGS. 9 and 10, the sorber 126 comprises a housing 128 which includes a top plate 130 that is attached to a bottom plate 132, and a sorbent 134 which is positioned between the top and bottom plates. In this example, the top plate 130 comprises a first electrical conductor and the bottom plate comprises a second electrical conductor. Accordingly, the top and bottom plates 130, 132 are made of a suitable electrically conductive material, such as an aluminum alloy. In addition, the top and bottom plates 130, 132 are electrically insulated from each other, such as by a suitable gasket 136 or any of the means previously described. Furthermore, the top and bottom plates 130, 132 are secured together with a number of suitable fasteners 138, such as high strength steel bolts. Also, as shown most clearly in FIG. 11, an insulating grommet 140, which is made of an appropriate electrically insulating and heat resistant material, such as Teflon®, is positioned between each bolt 138 and the top plate 130 to electrically insulate the bolt, and thus the bottom plate 132, from the top plate. The refrigerant is communicated between the sorbent 134 and the refrigeration loop through an inlet port 46 and an outlet port 46, which may both be formed in the top plate 130.

The sorber 126 is preferably designed to help dissipate the heat of adsorption from the refrigerant/sorbent compound. Thus, in addition to being electrically conductive, the top and bottom plates 130, 132 are preferably constructed of a material having a good thermal conductivity. In addition, if as shown in FIGS. 9 and 10 the sorbent 134 comprises relatively large top and bottom surfaces 142, 144, respectively, compared to its thickness "t", the top and bottom plates 130, 132 preferably each include a respective inner surface 142', 144' which engages substantially the entire corresponding top or bottom surface 142, 144. In this manner, the thermal diffusion path length for the refrigerant/sorbent compound will be minimized (in effect one-half the thickness "t"), and the rate of heat transfer from the refrigerant/sorbent compound will consequently be maximized. In addition, the top plate 130 or the bottom plate 132, or both, may be provided with cooling fins 146 to assist in the dissipation of the heat of adsorption from the refrigerant/sorbent compound. As shown in FIG. 8, the cooling fins 146 are ideally exposed to the external environment through an opening 148 in the housing 12.

The transfer of thermal and electrical energy through the junction between the refrigerant/sorbent compound and the sorber 126 is preferably optimized by enhancing the contact between the sorbent 134 and the top and bottom plates 130, 132. Depending on the sorbent 134 which is employed in the thermal storage device 300, this may be accomplished by soldering or brazing the sorbent to the top and/or bottom plates 130, 132. Alternatively, the sorbent 134 may be affixed to the top and/or bottom plates 130, 132 using a suitable thermally and electrically conductive adhesive. Where brazing, soldering or gluing are not appropriate, the sorbent 134 and the sorber 126 may be designed with a slight interference fit to produce a suitable contact pressure between the sorbent and the top and bottom plates 130, 132. The contact between the sorbent 134 and the sorber 126 may also be enhanced by positioning a foil of soft metal, such as indium, between the sorbent and each of the top and bottom plates 130, 132.

In the embodiment of the invention shown in FIGS. 9 and 10, the sorbent 134 is formed into a monolithic member having a thickness "t" and generally parallel top and bottom surfaces 142, 144 which each have a length "l" and a width "w". Although the surfaces 142, 144 are depicted as being rectangular, they could have any practical shape. Since in this embodiment the top and bottom plates 130, 132 of the sorber 126 function to both conduct the electrical current across and dissipate the heat of adsorption from the refrigerant/sorbent compound, the electrical conduction and thermal diffusion paths of the sorbent 134 are both aligned in the direction of the thickness "t". As mentioned above, in order to maximize the amount of power which is transferred to the refrigerant/sorbent compound from an AC power supply, the combined impedance of the sorber 126 and the refrigerant/sorbent compound should match that of the external power supply. Thus, for given refrigerant and sorbent materials, the thickness "t" of the sorbent may be increased or decreased to adjust the impedance accordingly.

However, in order to minimize the thermal diffusion path length through the sorbent 134, the thickness "t" should be kept as small as possible. In the event the heat of adsorption is dissipated through both the top and bottom surfaces 142, 144, the thickness "t" is preferably less than the smallest linear dimension of the top or bottom surface, which, for example, is the length of the minor side of a rectangle, the length of any side of a square, or the length of the diameter of a circle. If the heat of adsorption is dissipated through only one of the top and bottom surfaces 142, 144, the thickness "t" is preferably less than one-half the smallest linear dimension of the top or bottom surface. More preferably, the thickness "t" is less than one-tenth the smallest linear dimension of the top or bottom surface. By sizing the sorbent 134 accordingly, the minimum thermal diffusion path length will be transverse to the top and bottom surfaces 142, 144, and the heat of adsorption will consequently be readily dissipated through either or both of these surfaces.

The thermal storage device 300 optimally includes a power cord 150 to connect the sorber 126 to an external power supply (not shown). The power cord 150 may be connected to the sorber 126 either directly, in the event the external power source generates a current which is useable by the sorber, or otherwise through an internal power supply 110. If desired, the power cord 150 may be removably connected to a power jack which in turn is connected to the sorber 126 or the internal power supply 110. This will enable the thermal storage device 300 to be transported more easily. The operation of the thermal storage device 300 is similar to that of the thermal storage device 10 discussed above.

Figure 12:
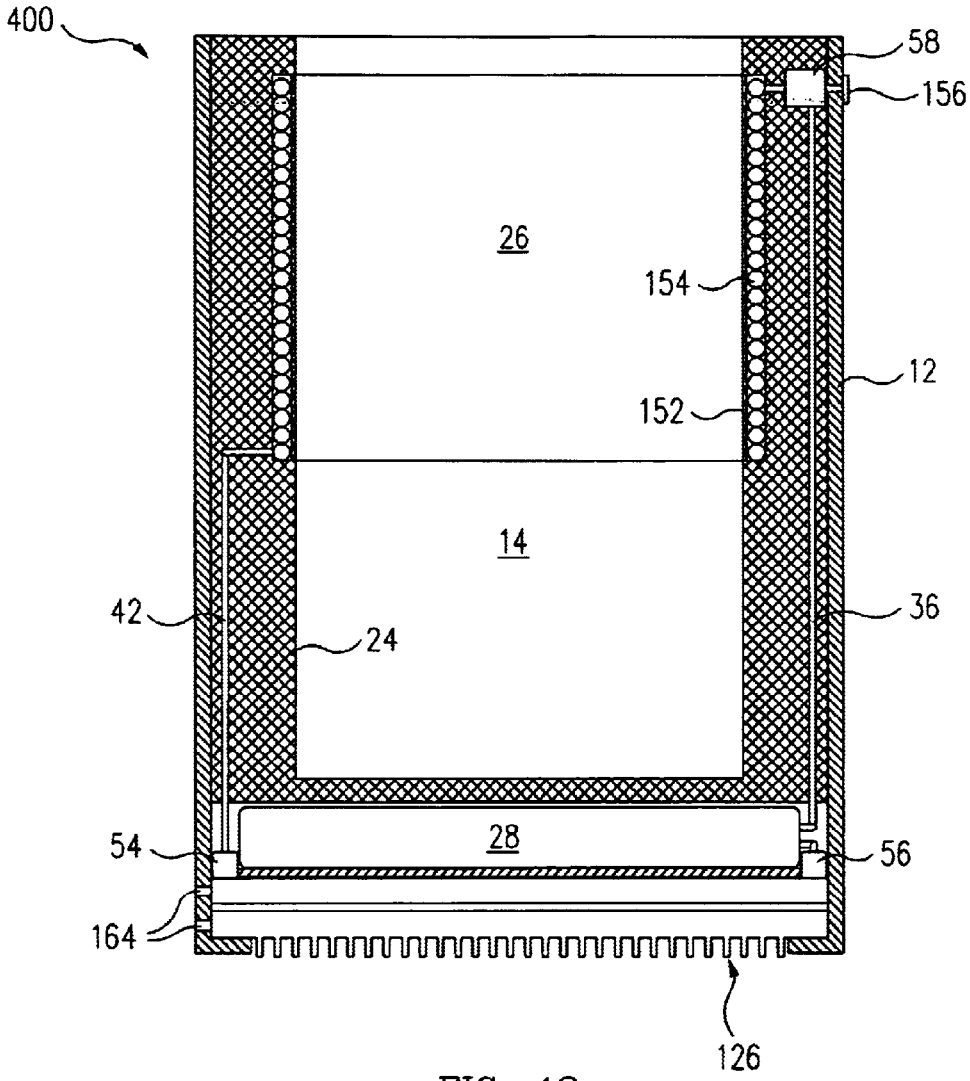
FIG. 12 is a cross sectional view of another embodiment of a thermal storage device of the present invention.

Referring now to FIG. 12, a further embodiment of a thermal storage device is shown which is especially useful in refrigerating individual items such as bottles and cans. The thermal storage device of this embodiment, generally 400, is shown to comprise a housing 12 which surrounds a compartment 14, an evaporator 26 which is positioned in heat exchange relation with respect to the compartment, a receiver 28 which is fluidly connected to the evaporator, and a sorber 126 which is fluidly connected between the evaporator and the receiver. In this embodiment, the top of the housing 12 may be left open to allow elongated articles to at least be partially received within the compartment 14. In addition, the evaporator 26 may include a cooling cylinder 152 which comprises an inner diameter that is sized to engage the outer diameter of a standard sized article and an outer diameter that is attached to an evaporator tube 154, such as by brazing. The cooling cylinder 152 is ideally comprised of a material having a relatively high thermal conductivity, such as aluminum.

The thermal storage device 400 is preferably inexpensive to produce, sufficiently lightweight to be hand carried with an article to be cooled inserted therein, and simple to operate. Therefore, the flow control device 58 is optimally a manually operable valve which can be actuated via a push button 156. In addition, the thermal storage device 400 ideally does not include an internal power supply, a temperature sensor or a controller. Instead, certain of these components may be located in a separate recharging stand.

Figure 13:
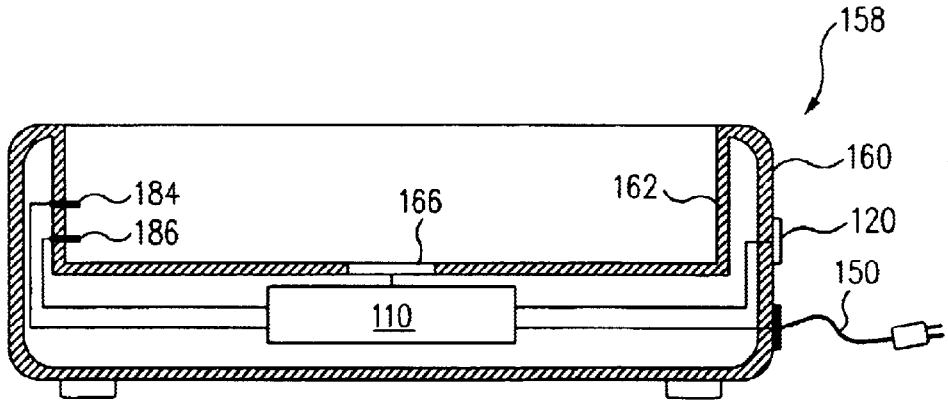
FIG. 13 is a cross sectional view of an exemplary re-charging stand for the thermal storage device shown in FIG. 12.

Referring also to FIG. 13, such a recharging stand, which is indicated generally by reference number 158, is shown to comprise a base 160 which includes a receptacle 162 that is sized to receive the lower portion of the housing 12 of the thermal storage device 400. The recharging stand 158 also includes a pair of preferably retractable leads 184, 186 which are movably mounted in the base 160 and which will engage the top and bottom plates 130, 132 of the sorber 126 through corresponding holes 164 in the housing 12 when the thermal storage device 400 is inserted in the receptacle 162. The recharging stand 158 may also comprise a power cord 150 to connect the leads 184, 186 to an external power source (not shown), an internal power source 110 to convert the power from the external power source into a form which is usable by the sorber 126, and a manual power switch 120 to enable the leads to be selectively engaged and disengaged from the external power source. The recharging stand 158 preferably also includes a conventional thermal switch 166 which engages the sorber 126 when the thermal storage device 400 is inserted into the receptacle 162 and operates to electrically disconnect the power cord 150 from the leads 184, 186 once it detects a predetermined temperature.

In operation, the sorber 126 is charged by inserting the thermal storage device 400 into the recharging stand 158 and pressing the switch 120. Power from the external power supply will consequently be conducted through the leads 184, 186 to the sorber 126 to desorb the refrigerant from the sorbent. The refrigerant will accordingly expand through the check valve 56 and into the receiver 28, where it will stay as long as the valve 58 remains closed. When the refrigerant has been substantially fully desorbed from the sorbent, the temperature of the sorber 126 will increase, and the thermal switch 166 will cut the power to the leads 184, 186. An article to be refrigerated, such as a beverage can, may then be placed in the compartment 14 and carried about. Once the temperature of the article rises above a desired temperature, the valve 58 may be manually actuated to release the refrigerant into the evaporator to thereby cool the article. If sufficient refrigerant remains in the receiver 28, the article may be repeatedly cooled in this fashion.

It should be recognized that, while the present invention has been described in relation to the preferred embodiments thereof, those skilled in the art may develop a wide variation of structural and operational details without departing from the principles of the invention. For example, the various elements shown in the different embodiments may be combined in a manner not illustrated above. Therefore, the appended claims are to be construed to cover all equivalents falling within the true scope and spirit of the invention.

What is claimed is:

1. A thermal storage device for maintaining the temperature of an article at a desired temperature for a length of time, the thermal storage device comprising:

a compartment within which the article may be positioned;

an evaporator which is disposed in heat exchange relation with respect to the compartment;

a receiver which is fluidly connected to the evaporator;

a sorber which is fluidly connected between the evaporator and the receiver and which includes a sorbent that is capable of adsorbing a refrigerant;

means for desorbing the refrigerant from the sorbent;

means for releasably connecting an external power supply to the desorbing means;

wherein when the desorbing means is connected to the external power supply, the refrigerant is desorbed from the sorbent and communicated to the receiver;

wherein after the desorbing means is disconnected from the external power supply, the refrigerant within the receiver is evaporated in the evaporator and adsorbed onto the sorbent to thereby produce a cooling effect in the compartment; and wherein the sorber comprises first and second spaced apart electrical conductors between which the sorbent is disposed, and the desorbing means comprises the first and second conductors.

2. The thermal storage device of claim 1, wherein the sorber comprises:

a tubular housing which comprises the first conductor; and a cylindrical sleeve which is supported within the housing and which comprises the second conductor.

3. The thermal storage device of claim 2, further comprising means for electrically insulating the first conductor from the second conductor.

4. The thermal storage device of claim 3, wherein the insulating means comprises at least one support member which is comprised of a nonconducting material and which includes a first portion that is positioned between the sleeve and the housing.

5. The thermal storage device of claim 4, wherein the insulating means comprises an elongated shaft which includes a second portion on which the sleeve is supported.

6. The thermal storage device of claim 5, wherein:

the sorber comprises an inlet which is formed in a first end of the housing and an outlet which is formed in a second end of the housing;

the shaft comprises a longitudinal bore which extends between the inlet and the outlet and a number of radial holes which extend through the shaft and intersect the longitudinal bore; and the sleeve comprises a number of apertures which extend between the radial holes and the sorbent.

7. The thermal storage device of claim 2, wherein the sleeve extends between and is supported by a first end of the housing and a second end of the housing, and the sorber further comprises means for electrically insulating the sleeve from the housing.

8. The thermal storage device of claim 7, wherein the insulating means comprises a gasket which is positioned between the sleeve and the first and second ends.

9. The thermal storage device of claim 7, wherein the insulating means comprises an anodized coating which is disposed between the sleeve and the first and second ends.

10. The thermal storage device of claim 7, wherein:

the sorber comprises an inlet which is formed in the first end of the housing and an outlet which is formed in the second end of the housing; and the sleeve comprises a longitudinal bore which extends between the inlet and the outlet and a number of radial holes which communicate between the longitudinal bore and the sorbent.

11. The thermal storage device of claim 1, wherein the sorber comprises a housing which includes a first generally flat plate that comprises the first conductor, a second generally flat plate that comprises the second conductor, and means for securing the first plate to the second plate.

12. The thermal storage device of claim 11, wherein the sorbent comprises first and second spaced-apart, generally parallel surfaces and a thickness which is transverse to the first and second surfaces, and the thickness is less than one-half a smallest linear dimension of the surfaces.

13. The thermal storage device of claim 11, wherein the sorbent is attached to at least one of the first and second conductors.

14. The thermal storage device of claim 1, wherein the desorption of the refrigerant from the sorbent is a substantially non-thermal reaction.

15. The thermal storage device of claim 1, wherein the sorber comprises an impedance which is approximately the same as the impedance of the external power supply.

* * * * *